US009468296B1

(12) United States Patent
Chen

(10) Patent No.: US 9,468,296 B1
(45) Date of Patent: Oct. 18, 2016

(54) ASYMMETRIC SWING

(71) Applicant: Samuel Chen, Shanghai (CN)

(72) Inventor: Samuel Chen, Shanghai (CN)

( * ) Notice: Subject to any disclaimer, the term of this patent is extended or adjusted under 35 U.S.C. 154(b) by 0 days.

(21) Appl. No.: 14/929,777

(22) Filed: Nov. 2, 2015

Related U.S. Application Data

(63) Continuation-in-part of application No. 29/539,956, filed on Sep. 18, 2015.

(51) Int. Cl.
*A63G 9/00* (2006.01)
*A47C 3/025* (2006.01)
*A47D 13/10* (2006.01)

(52) U.S. Cl.
CPC ..... *A47C 3/0255* (2013.01); *A47D 13/105* (2013.01); *A63G 9/00* (2013.01)

(58) Field of Classification Search
CPC ..... A63G 9/00; A63G 9/02; A63G 9/12; A47C 3/0255; A47C 11/005
USPC ..... 472/118–125; 297/245
See application file for complete search history.

(56) References Cited

U.S. PATENT DOCUMENTS 623,254 A * 4/1899 McGlamery ..... A47D 11/005 297/245
683,495 A * 10/1901 Hayes ..... B60P 3/32 123/146.5 A
3,825,299 A * 7/1974 Gaucher ..... A63G 9/02 297/157.1
9,061,213 B2 * 6/2015 Hsu ..... A63G 9/00

* cited by examiner

*Primary Examiner* — Kien Nguyen
(74) *Attorney, Agent, or Firm* — Clement Cheng

(57) ABSTRACT

An asymmetric swing has a large seat having a large seat seat bottom. A large seat frame connected to the large seat. The large seat frame includes a large seat right frame and a large seat left frame. A small seat has a small seat seat bottom that is smaller in supporting surface area than the large seat seat bottom. A small seat frame is connected to the small seat. A pair of suspension brackets include a first suspension bracket and a second suspension bracket. The large seat frame and the small seat frame are suspended from the pair of suspension brackets. The large seat is connected to the foot pedal and the small seat is connected to the foot pedal. The large seat frame, the small seat frame, the foot pedal, and the pair of suspension brackets are pivotally jointed to form a four bar mechanism.

11 Claims, 8 Drawing Sheets

ASYMMETRIC SWING

This application is a continuation in part and claims priority from U.S. design patent application 29/539,956 by same inventor Samuel Chen, filed Sep. 18, 2015 entitled Asymmetric Swing, the disclosure of which is incorporated herein by reference.

FIELD OF THE INVENTION

The present invention is in the field of backyard and playground swings.

DISCUSSION OF RELATED ART

A variety of different playground swings can be made according to different styles and functions. Some swings are asymmetric in design such as for example a swing described in U.S. Pat. No. 9,084,940 by inventor Thomas Robert Norquist entitled Swing Designed To Promote Attunement Between Child And Caretaker, issued Jul. 21, 2015, the disclosure of which is incorporated herein by reference. Also European patent number EP2067510 issued Jun. 10, 2009 by inventor Saara Linna entitled Family Swing, the disclosure of which is incorporated herein by reference, provides for an asymmetric swing.

SUMMARY OF THE INVENTION

An asymmetric swing has a large seat having a large seat seat bottom. A large seat frame connected to the large seat. The large seat frame includes a large seat right frame and a large seat left frame. A small seat has a small seat seat bottom. The small seat seat bottom is smaller in supporting surface area than the large seat seat bottom. A small seat frame is connected to the small seat. A pair of suspension brackets include a first suspension bracket and a second suspension bracket. The large seat frame and the small seat frame are suspended from the pair of suspension brackets. The large seat is connected to the foot pedal and the small seat is connected to the foot pedal. The large seat frame, the small seat frame, the foot pedal, and the pair of suspension brackets are pivotally jointed to form a four bar mechanism.

The small seat frame includes a small seat left frame and a small seat right frame that join together at a small seat frame connection. The small seat frame has a small seat frame upper right pivot connected to the first suspension bracket and a small seat frame upper left pivot connected to the second suspension bracket. The large seat frame has a large seat frame upper right pivot connected to the second suspension bracket and a large seat frame upper left pivot connected to the first suspension bracket. The first suspension bracket and the second suspension bracket are spaced apart from each other laterally.

The small seat frame further includes a small seat left frame and a small seat right frame. The small seat further includes a small seat seatback. The small seat seatback is vertically arranged and facing the asymmetric swing. The small seat seatback is connected to the small seat frame at the small seat left frame and the small seat right frame. The large seat frame has a large seat right frame and a large seat left frame connecting together at a large seat frame bottom portion that is pivotally connected to the foot pedal. The large seat frame has a large seat right frame and a large seat left frame spaced apart from each other such that a large seat left armrest is connected to the large seat left frame. A large seat right armrest is connected to the large seat right frame.

The large seat seat bottom is supported between the large seat left armrest and the large seat right armrest.

The foot rest pedal may have a rounded oval or circular shape tubular metal member with protrusions extending downward from the tubular metal member. The protrusions include a foot rest pedal first joint and a foot rest pedal second joint.

The large seat has a large seat seatback that has a large seat seatback curved portion extending beyond the large seat frame.

Figure 1:
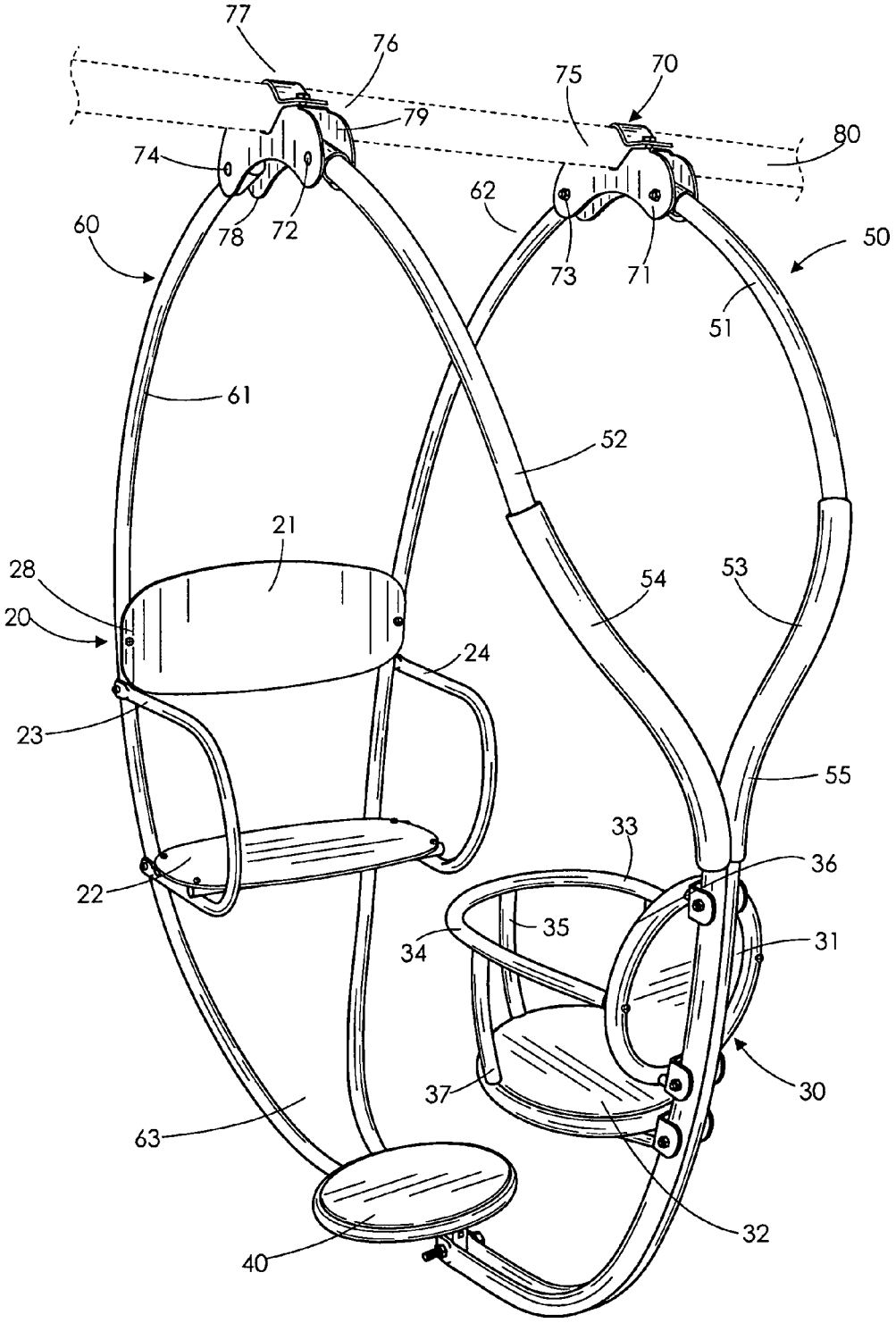
FIG. 1 is a front perspective view of the present invention.
Figure 2:
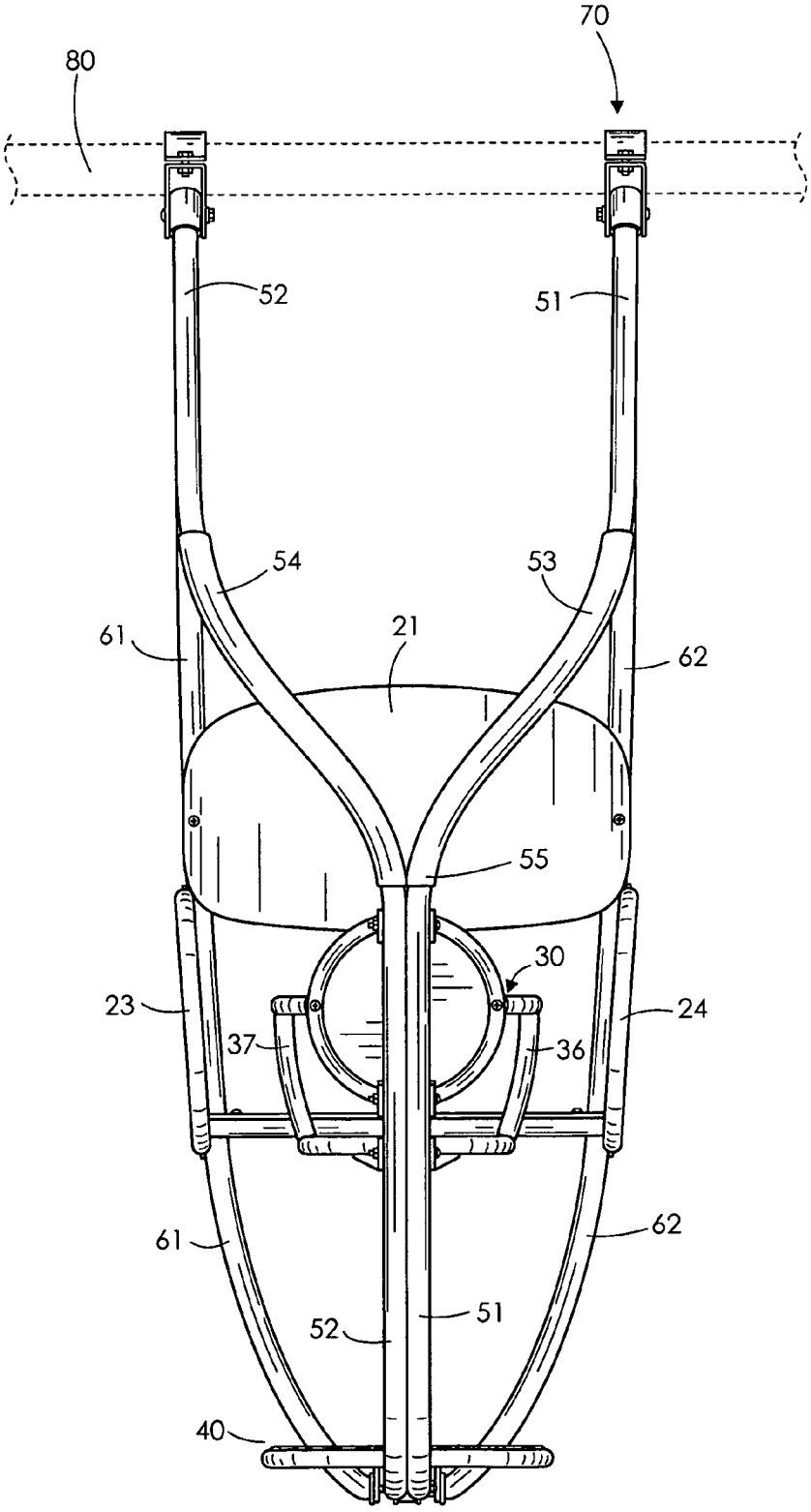
FIG. 2 is a front view.
Figure 3:
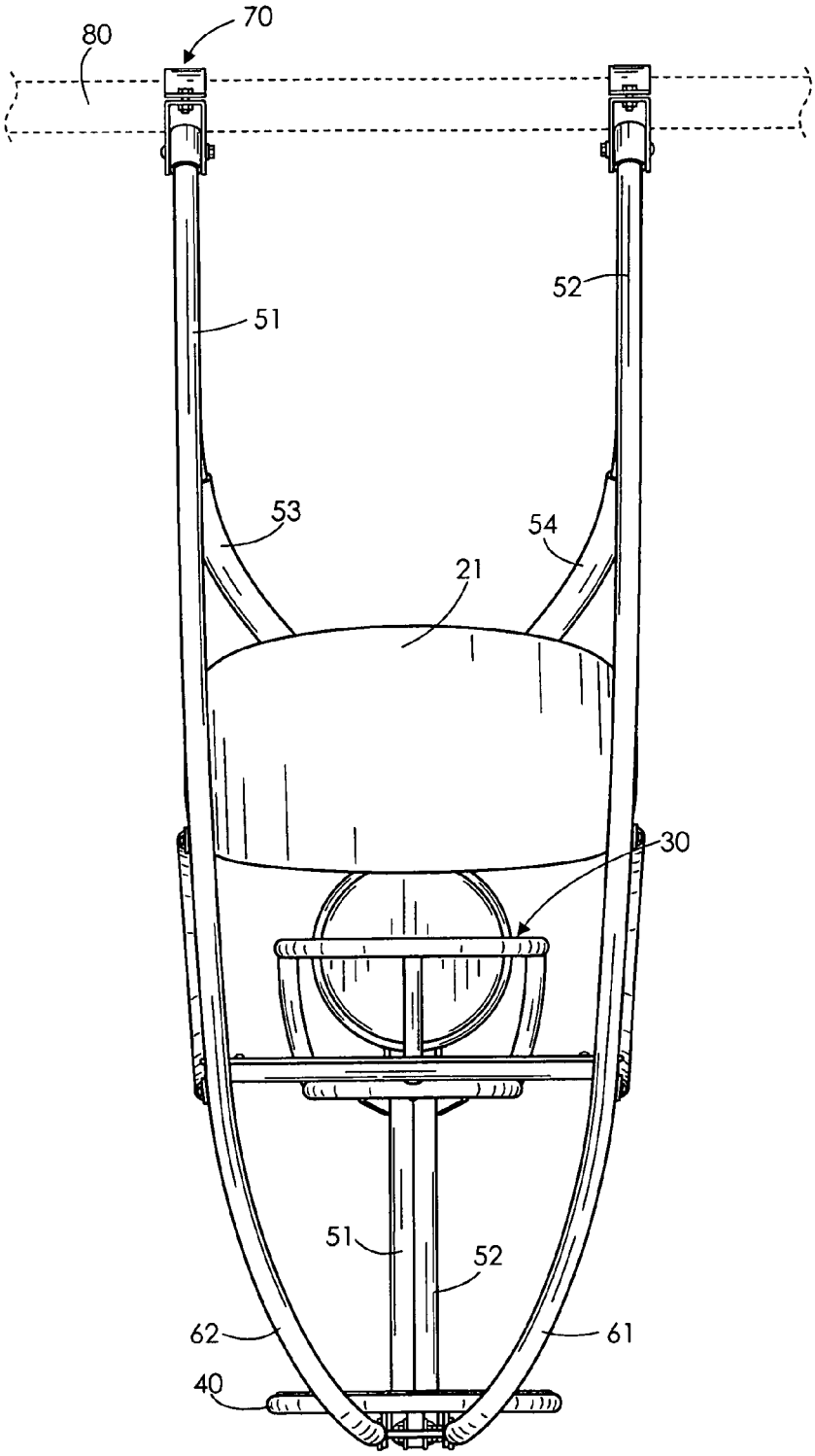
FIG. 3 is a rearview.
Figure 4:
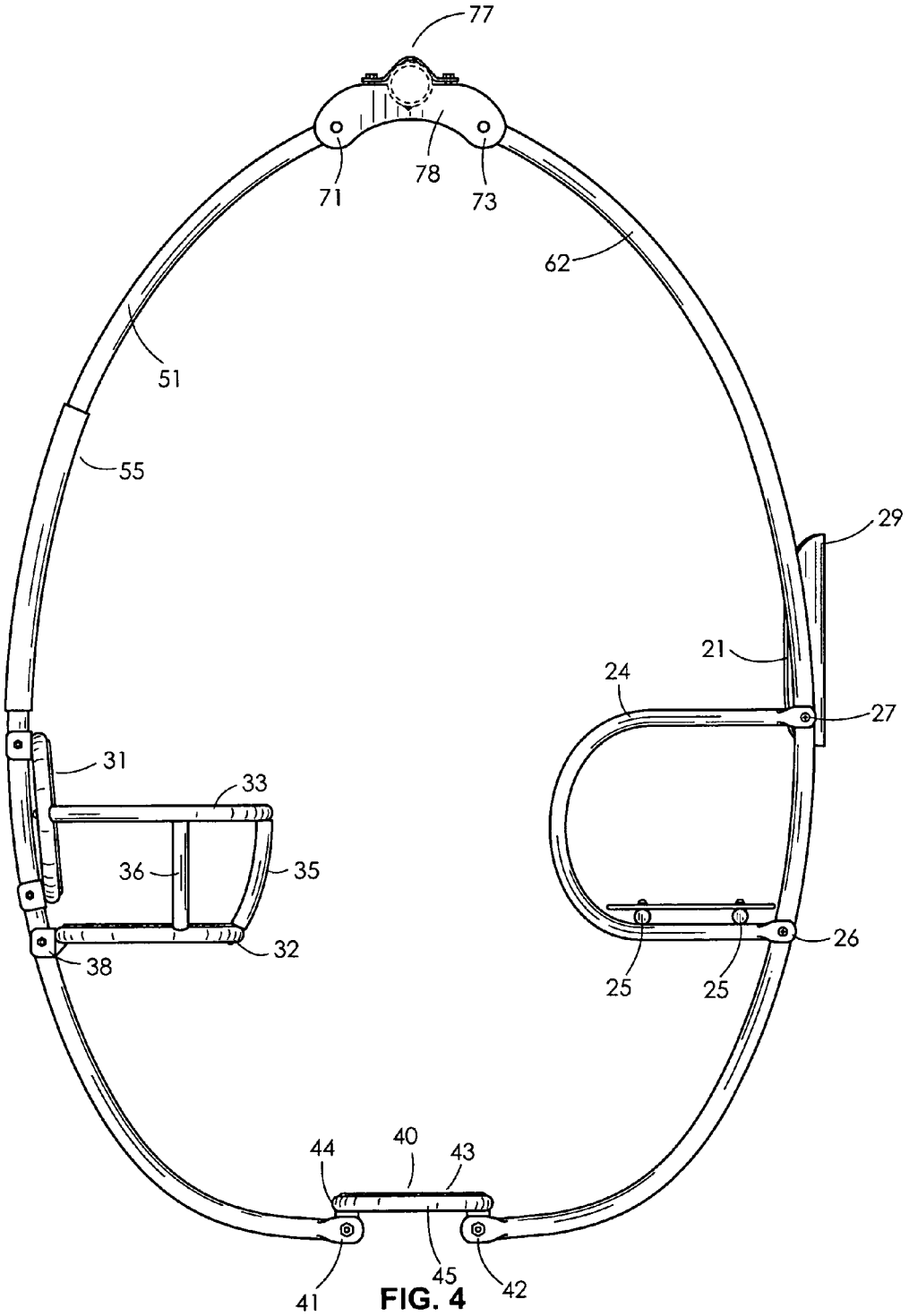
FIG. 4 is a left side view.
Figure 5:
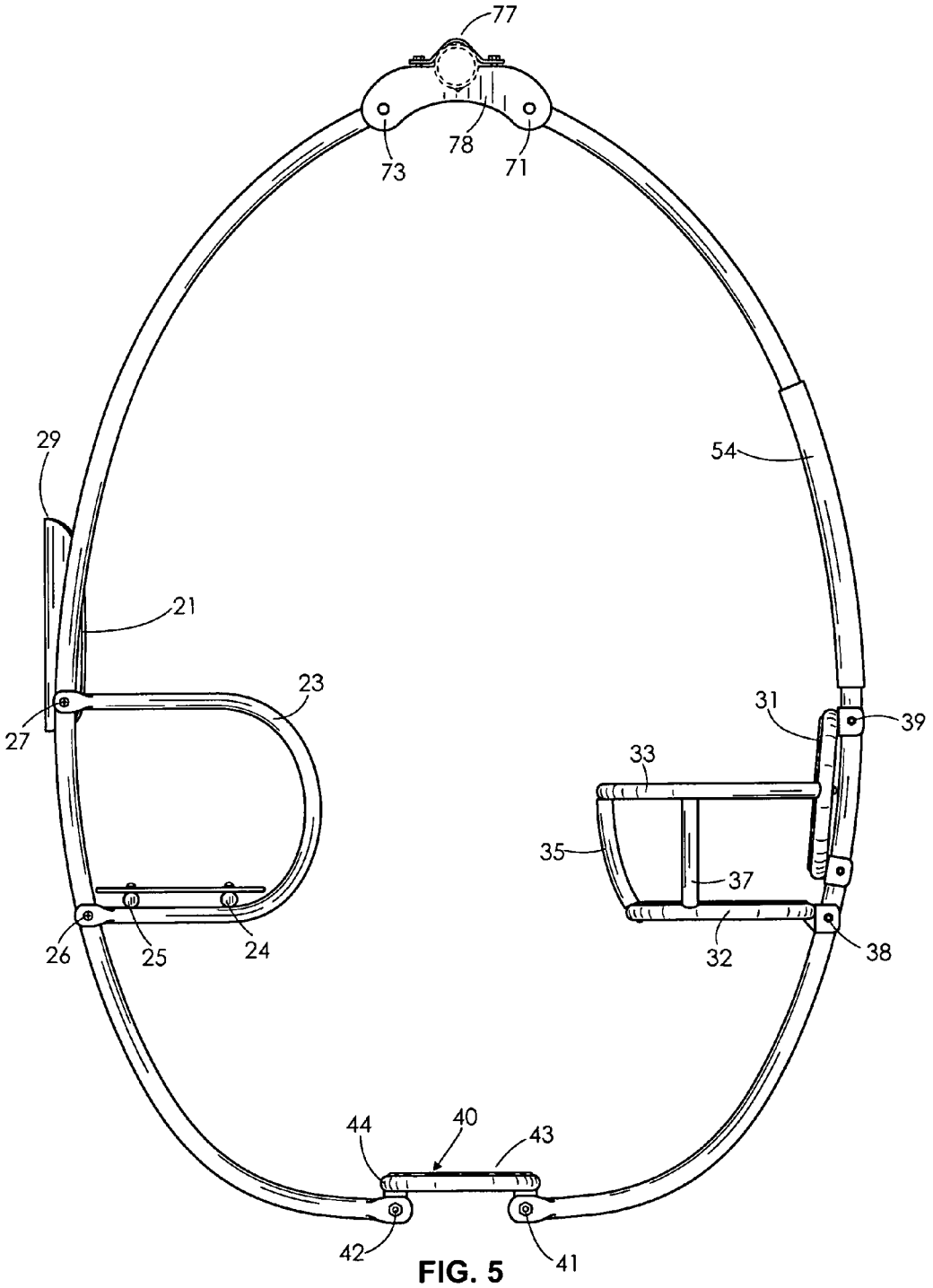
FIG. 5 is a right side view.
Figure 6:
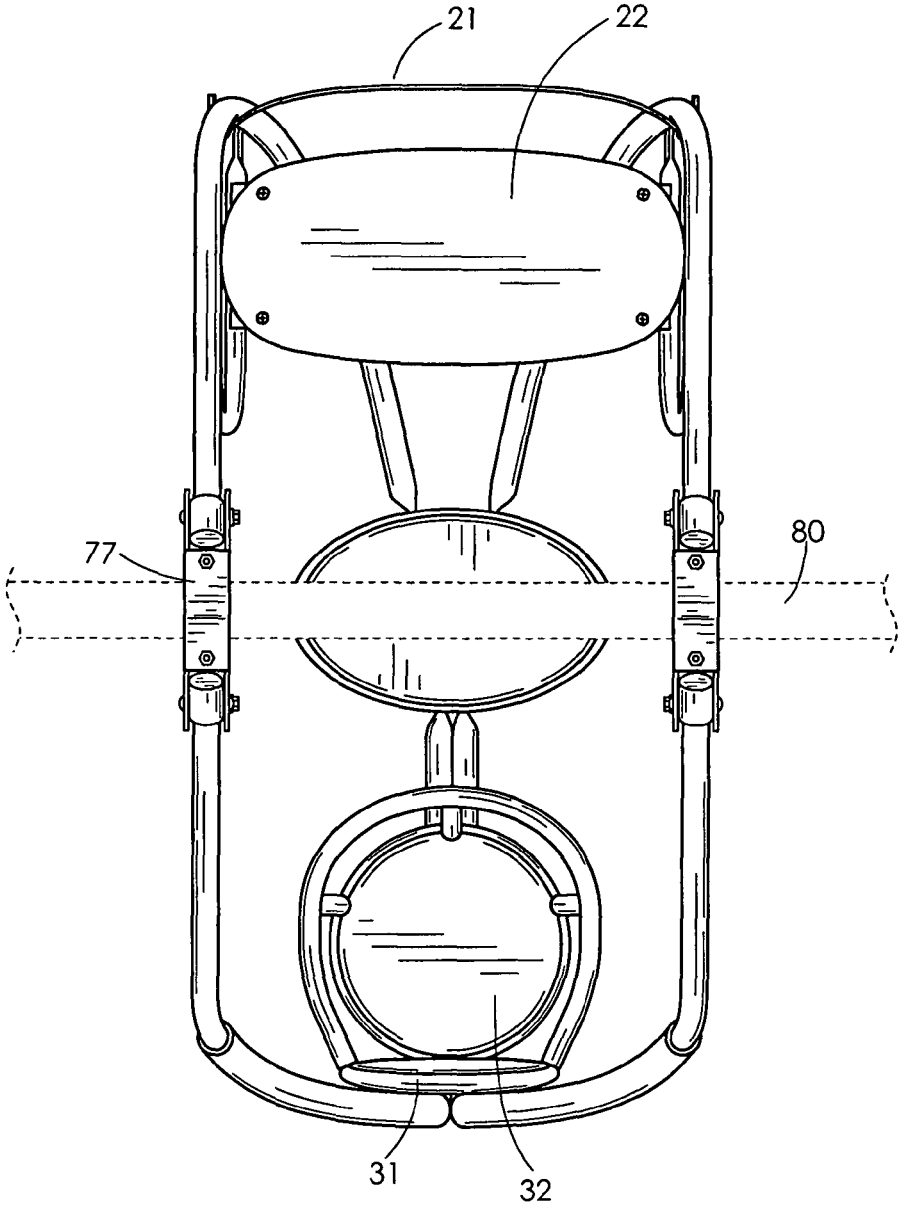
FIG. 6 is a top view.
Figure 7:
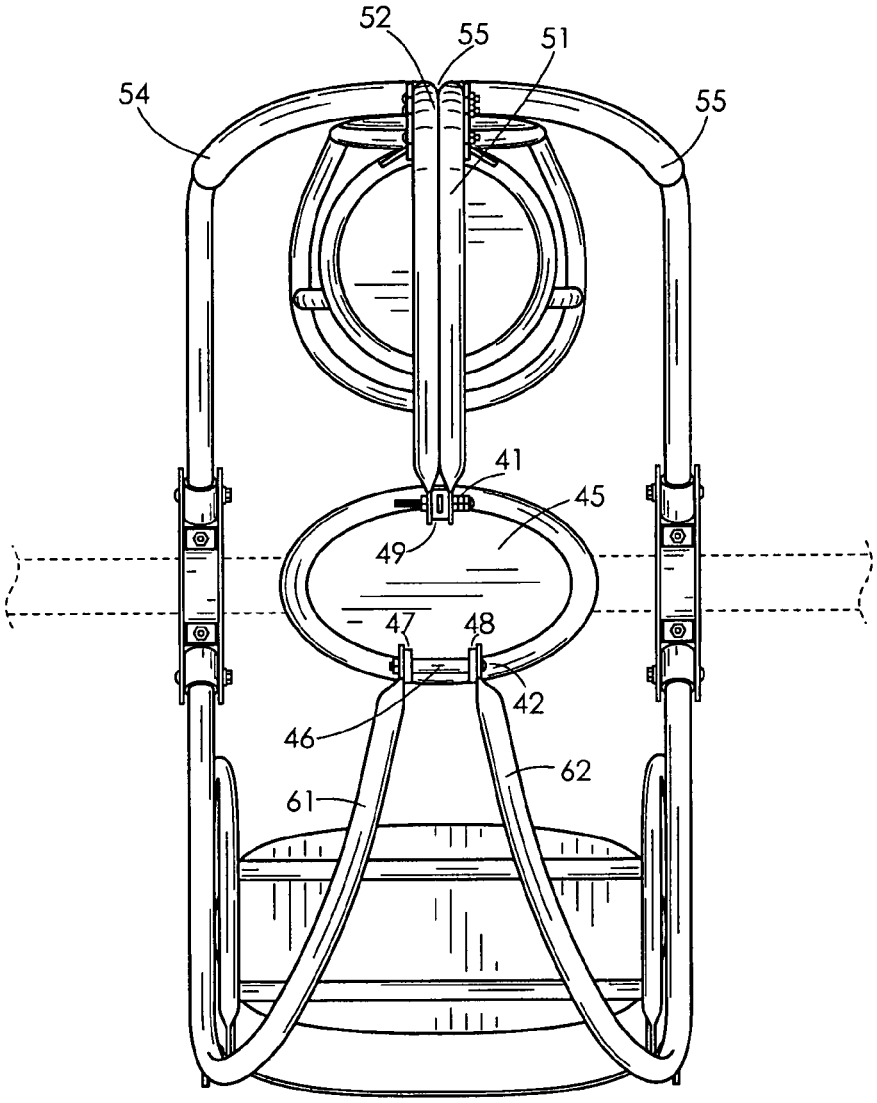
FIG. 7 is a bottom view.
Figure 8:
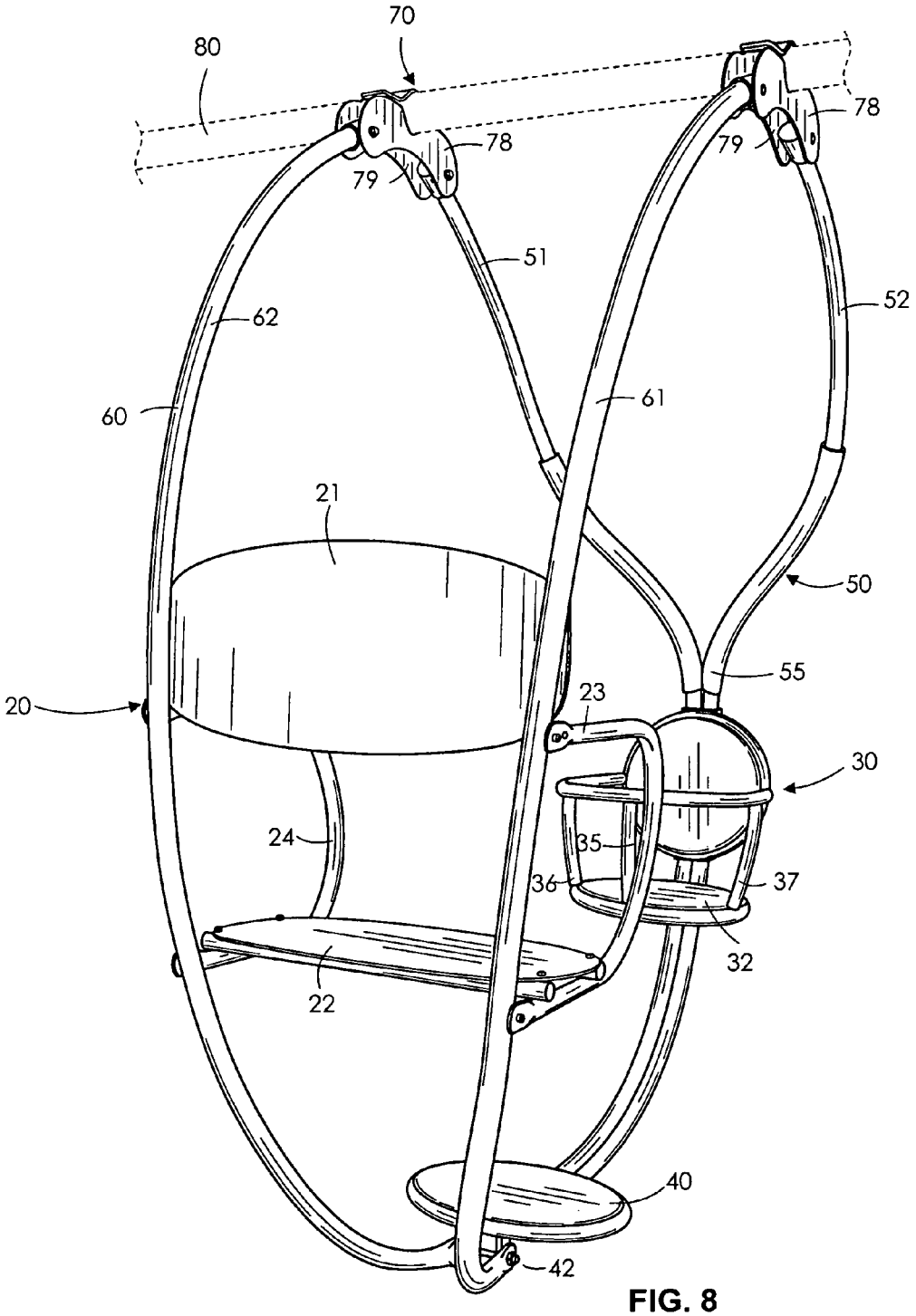
FIG. 8 is a rear perspective view.

The following call out list of elements can be a useful guide in referencing the elements of the drawings.

20 Large Seat
21 Large Seat Seatback
22 Large Seat Seat Bottom
23 Large Seat Right Armrest
24 Large Seat Left Armrest
25 Large Seat Bottom Rear Horizontal Support
125 Large Seat Bottom Front Horizontal Support
26 Large Seat Armrest Lower Connection
27 Large Seat Armrest Upper Connection
28 Large Seat Seatback Connection
29 Lower Seat Seatback Curved Portion
30 Small Seat
31 Small Seat Seatback
32 Small Seat Seat Bottom
33 Small Seat Right Armrest
34 Small Seat Left Armrest
35 Small Seat Armrest Middle Support
36 Small Seat Armrest Right Support
37 Small Seat Armrest Left Support
38 Small Seat Lower Connection
39 Small Seat Upper Connection
40 Foot Pedal
41 Foot Pedal First Joint
42 Foot Pedal Second Joint
43 Foot Pedal Top Plank
44 Foot Pedal Frame
45 Foot Pedal Hollow
46 Second Joint Spacer
47 Foot Pedal Second Joint Right Flange
48 Foot Pedal Second Joint Left Flange
49 First Pedal First Joint Flange
50 Small Seat Frame
51 Small Seat Right Frame
52 Small Seat Left Frame
53 Small Seat Right Frame Cushion
54 Small Seat Left Frame Cushion
55 Small Seat Frame Connection
60 Large Seat Frame
61 Large Seat Right Frame
62 Large Seat Left Frame
63 Large Seat Frame Gap
70 Suspension Bracket Pair
71 Small Seat Frame Upper Right Pivot
72 Small Seat Frame Upper Left Pivot

73 Large Seat Frame Left Upper Pivot
74 Large Seat Frame Right Upper Pivot
75 First Suspension Bracket
76 Second Suspension Bracket
77 Suspension Bracket Upper Plate
78 Suspension Bracket Lower Plate
79 Suspension Bracket Lower Plate Gap
80 Horizontal Support Member

DETAILED DESCRIPTION OF THE PREFERRED EMBODIMENT

The present invention is an asymmetric swing with a large seat and a small seat suspended from a support member such as a horizontal support member 80. The large seat and the small seat are connected together at a foot pedal 40 which can be an articulated foot pedal. The large seat and the small seat are also connected to frames. A large seat frame 60 connects to the large seat 20 and a small seat frame 50 connects to a small seat 30.

Preferably, the asymmetric swing is arranged as a four bar mechanism with a suspension bracket pair 70 being a first bar, a large seat frame 60 being a second bar, a small seat frame 30 being a third bar, and an articulated foot pedal 40 being the fourth bar. The four bars of the four bar mechanism are connected together at pivot points. At an upper portion of the asymmetric swing, the suspension bracket 70 is pivotally connected to the small seat frame 50 at a small seat frame upper right pivot 71 and a small seat frame upper left pivot 72. Also at an upper portion of the asymmetric swing, the large seat frame 60 is pivotally connected to the suspension bracket pair 70 at a large seat frame upper left pivot 73 and a large seat frame upper right pivot 74. At a lower portion of the asymmetric swing, the large seat frame 60 is pivotally connected to the foot pedal 40 at a foot pedal second joint 42. Also at a lower portion of the asymmetric swing, the small seat frame 30 is pivotally connected to the foot pedal 40 at a foot pedal first joint 41.

A user sitting on the large seat can initiate and control the rocking motion of the asymmetric swing by pushing on the foot pedal 40. The foot pedal 40 has a surface area that is approximately equivalent to the area of the small seat. The foot pedal 40 has a foot pedal top plank 43 mounted over a foot pedal frame 44. The foot pedal frame 44 is shown as an oval tubular steel member having protrusions from the bottom of the tubular steel member. The protrusions are connected to the joints. The foot pedal second joint right flange 47 and the foot pedal second joint left flange both extend downwardly from the tubular steel member of the foot pedal frame 44. A second joint spacer 46 fits between the foot pedal second joint right flange 47 and the foot pedal second joint left flange 48. The foot pedal first joint flange 49 is connected to the foot pedal first joint 41.

The foot pedal first joint 41 is formed by flattening the lower ends of the small seat right frame 51 and the small seat left frame 52 so that the flattened lower portion of the small seat right frame 51 and the flattened lower portion of the small seat left frame 52 meet the left and right sides of the first joint flange 49. A bolt or pin joint member fits through an opening on the small seat right frame 51, then through an opening on the first joint flange 49, then through an opening on the small seat left frame 52.

The foot pedal second joint 42 is formed by flattening the lower ends of the large seat left frame 62 and the large seat right frame 61. The flattened lower ends are vertically oriented. The large seat left frame 62 abuts the foot pedal second joint left flange 48, and the large seat right frame of the one abuts the foot pedal second joint right flange 47 with the second joint spacer 46 optionally fitted between the foot pedal second joint right flange 47 and the foot pedal second joint left flange 48. The plurality of flanges can be welded to the lower surface of the foot pedal frame 44 so that they extend downward from the lower surface of the foot pedal frame 44.

The large seat 20 has a large seat seatback 21 mounted between the large seat right frame 61 and the large seat left frame 62. The large seat 20 also has a large seat seat bottom 22 mounted to a large seat right armrest 23 and a large seat left armrest 24. The large seat armrests are mounted to the large seat frame 60 at a large seat armrests lower connection 26 and a large seat armrest upper connection 27. The large seat seatback 21 is mounted across the large seat frame gap 63 that is formed between the large seat frame members. The large seat seatback 21 is connected to the large seat frame members at a pair of large seat back connections 28. The large seat right armrest 23 and the large seat left armrest 24 collectively support a large seat bottom rear horizontal support 25 and a large seat bottom front horizontal support 125. The large seat bottom rear horizontal support 25 and the large seat bottom front horizontal support 125 are parallel to each other and are mounted to the large seat right and left armrests. The large seat seat bottom 22 is formed as an oval or pill shaped plank that can be mounted to the large seat seat bottom front horizontal support 125 and the large seat bottom rear horizontal support 25 using connectors such as screws.

The large seat seatback curved portion 29 extends beyond the large seat frame 60. The large seat frame 60 large seat right frame 61 and large seat left frame 62 connect together at a bottom portion on the foot rest pedal second joint 42. The large seat right frame 61 and large seat left frame 62 separate and connect at the upper portion to the suspension bracket lower plate 78 of the suspension bracket pair 70.

The suspension bracket pair 70 includes a suspension bracket upper plate 77 and a suspension bracket lower plate 78. The suspension bracket lower plate 78 is bent and folded twice at 90° angles to provide a suspension bracket lower plate gap 79 for receiving the two upper ends of the large seat frame 60 and the two upper ends of the small seat frame 50. The suspension bracket upper plate 77 can be angular shaped for receiving a square cross-section portion of a horizontal support member 80. The suspension bracket upper plate 77 is bolted to the suspension bracket lower plate 78 at two bolts that are vertically oriented. The suspension bracket pair 70 includes a first suspension bracket 75 and a second suspension bracket 76 which are laterally spaced from each other and both rigidly mounted to the horizontal support member 80 such that they do not move relative to each other.

The small seat frame 50 has a small seat right frame 51 and a small seat left frame 52 which are connected at their upper ends to the first suspension bracket 75 and the second suspension bracket 76. The small seat right frame and the small seat left frame bend toward each other and abut each other along a region of the small seat frame connection 55 to form a wishbone shaped profile. The small seat right frame 51 has a small seat right frame cushion 53 and the small seat left frame 52 has a small seat left frame cushion 54.

The small seat 30 has a small seatback 31. The small seatback 31 is vertically arranged and facing the asymmetric swing. The small seat seatback 31 is connected to the small seat frame 50 at the small seat left frame 51 and the small seat right frame 51. The small seat seatback 31 is connected to the small seat armrest, which includes the small seat left arm rest 34 and the small seat right arm rest 33. The small seat right arm rest 33 can be joined to the small seat left arm rest 34 as a single loop of tubular material. The small seat armrest is supported vertically at a small seat armrest middle support 35 connecting between the small seat armrest and the small seat seat bottom 32. Similarly, the small seat right arm rest 33 is connected to the small seat seat bottom 32 at the small seat armrest right support 36. The small seat left armrest 34 is connected to the small seat seat bottom 32 by a small seat armrest left support 37. The small seat armrest has a pair of ends that can be connected by connectors such as bolts or screws to the small seat seatback 31.

The balance of the large seat and a small seat provides a center of gravity near the foot pedal 40. As a user depresses the foot pedal 40, the asymmetric swing can rock and begin a cyclical motion.

The invention claimed is:

1. An asymmetric swing comprising:

a) a large seat having a large seat seat bottom;

b) a large seat frame connected to the large seat, wherein the large seat frame includes a large seat right frame and a large seat left frame;

c) a small seat having a small seat seat bottom, wherein the small seat seat bottom is smaller in supporting surface area than the large seat seat bottom;

d) a small seat frame connected to the small seat;

e) a pair of suspension brackets, namely a first suspension bracket and a second suspension bracket, wherein the large seat frame and the small seat frame are suspended from the pair of suspension brackets; and f) a foot pedal, wherein the large seat is connected to the foot pedal and the small seat is connected to the foot pedal, wherein the large seat frame, the small seat frame, the foot pedal, and the pair of suspension brackets are pivotally jointed to form a four bar mechanism, wherein the small seat frame includes a small seat left frame and a small seat right frame that join together at a small seat frame connection.

2. The asymmetric swing of claim 1, wherein the small seat frame has a small seat frame upper right pivot connected to the first suspension bracket and a small seat frame upper left pivot connected to the second suspension bracket, wherein the large seat frame has a large seat frame upper right pivot connected to the second suspension bracket and a large seat frame upper left pivot connected to the first suspension bracket, wherein the first suspension bracket and the second suspension bracket are spaced apart from each other laterally.

3. The asymmetric swing of claim 1, wherein the small seat frame further includes a small seat left frame and a small seat right frame, wherein the small seat further includes a small seat seatback, wherein the small seat seatback is vertically arranged and facing the asymmetric swing, wherein the small seat seatback is connected to the small seat frame at the small seat left frame and the small seat right frame.

4. An asymmetric swing comprising:

a) a large seat having a large seat seat bottom;

b) a large seat frame connected to the large seat, wherein the large seat frame includes a large seat right frame and a large seat left frame;

c) a small seat having a small seat seat bottom, wherein the small seat seat bottom is smaller in supporting surface area than the large seat seat bottom;

d) a small seat frame connected to the small seat;

e) a pair of suspension brackets, namely a first suspension bracket and a second suspension bracket, wherein the large seat frame and the small seat frame are suspended from the pair of suspension brackets; and f) a foot pedal, wherein the large seat is connected to the foot pedal and the small seat is connected to the foot pedal, wherein the large seat frame, the small seat frame, the foot pedal, and the pair of suspension brackets are pivotally jointed to form a four bar mechanism, wherein the large seat frame has a large seat right frame and a large seat left frame connecting together at a large seat frame bottom portion that is pivotally connected to the foot pedal.

5. The asymmetric swing of claim 4, wherein the large seat frame has a large seat right frame and a large seat left frame spaced apart from each other such that a large seat left armrest is connected to the large seat left frame, and a large seat right armrest is connected to the large seat right frame, wherein the large seat seat bottom is supported between the large seat left armrest and the large seat right armrest.

6. The asymmetric swing of claim 4, wherein the small seat frame further includes a small seat left frame and a small seat right frame, wherein the small seat further includes a small seat seatback, wherein the small seat seatback is vertically arranged and facing the asymmetric swing, wherein the small seat seatback is connected to the small seat frame at the small seat left frame and the small seat right frame.

7. An asymmetric swing comprising:

a) a large seat having a large seat seat bottom;

b) a large seat frame connected to the large seat, wherein the large seat frame includes a large seat right frame and a large seat left frame;

c) a small seat having a small seat seat bottom, wherein the small seat seat bottom is smaller in supporting surface area than the large seat seat bottom;

d) a small seat frame connected to the small seat;

e) a pair of suspension brackets, namely a first suspension bracket and a second suspension bracket, wherein the large seat frame and the small seat frame are suspended from the pair of suspension brackets; and f) a foot pedal, wherein the large seat is connected to the foot pedal and the small seat is connected to the foot pedal, wherein the large seat frame, the small seat frame, the foot pedal, and the pair of suspension brackets are pivotally jointed to form a four bar mechanism, wherein the foot rest pedal has a rounded oval or circular shape tubular metal member with protrusions extending downward from the tubular metal member, wherein the protrusions include a foot rest pedal first joint and a foot rest pedal second joint.

8. The asymmetric swing of claim 7, the large seat has a large seat seatback that has a large seat seatback curved portion extending beyond the large seat frame.

9. The asymmetric swing of claim 7, wherein the small seat frame includes a small seat left frame and a small seat right frame that join together at a small seat frame connection, wherein the small seat frame has a small seat frame upper right pivot connected to the first suspension bracket and a small seat frame upper left pivot connected to the second suspension bracket, wherein the large seat frame has a large seat frame upper right pivot connected to the second suspension bracket and a large seat frame upper left pivot connected to the first suspension bracket, wherein the first suspension bracket and the second suspension bracket are spaced apart from each other laterally.

10. The asymmetric swing of claim 7, wherein the large seat frame has a large seat right frame and a large seat left frame spaced apart from each other such that a large seat left armrest is connected to the large seat left frame, and a large seat right armrest is connected to the large seat right frame, wherein the large seat seat bottom is supported between the large seat left armrest and the large seat right armrest.

11. The asymmetric swing of claim 10, wherein the large seat has a large seat seatback that has a large seat seatback curved portion extending beyond the large seat frame, wherein the small seat frame includes a small seat left frame and a small seat right frame that join together at a small seat frame connection, wherein the small seat frame has a small seat frame upper right pivot connected to the first suspension bracket and a small seat frame upper left pivot connected to the second suspension bracket, wherein the large seat frame has a large seat frame upper right pivot connected to the second suspension bracket and a large seat frame upper left pivot connected to the first suspension bracket, wherein the first suspension bracket and the second suspension bracket are spaced apart from each other laterally, wherein the small seat frame further includes a small seat left frame and a small seat right frame, wherein the small seat further includes a small seat seatback, wherein the small seat seatback is vertically arranged and facing the asymmetric swing, wherein the small seat seatback is connected to the small seat frame at the small seat left frame and the small seat right frame, wherein the large seat frame has a large seat right frame and a large seat left frame connecting together at a large seat frame bottom portion that is pivotally connected to the foot pedal.

* * * * *